US009210996B1

(12) United States Patent
Kramer

(10) Patent No.: US 9,210,996 B1
(45) Date of Patent: Dec. 15, 2015

(54) MAGNETIC COSMETIC BRUSH STAND AND SLEEVE

(71) Applicant: Dorothy L. Kramer, Naples, FL (US)

(72) Inventor: Dorothy L. Kramer, Naples, FL (US)

( * ) Notice: Subject to any disclaimer, the term of this patent is extended or adjusted under 35 U.S.C. 154(b) by 0 days.

(21) Appl. No.: 14/289,742

(22) Filed: May 29, 2014

Related U.S. Application Data

(63) Continuation-in-part of application No. 13/482,608, filed on May 29, 2012.

(51) Int. Cl.
*A46B 15/00* (2006.01)
*A46B 17/02* (2006.01)
*B44D 3/12* (2006.01)

(52) U.S. Cl.
CPC ..... *A46B 15/0095* (2013.01); *A46B 17/02* (2013.01); *B44D 3/123* (2013.01)

(58) Field of Classification Search
CPC .... B44D 3/123; A46B 17/02; A46B 15/0095; A47F 5/02
See application file for complete search history.

(56) References Cited

U.S. PATENT DOCUMENTS

| | | | | | |
|---|---|---|---|---|---|
| 2,150,784 | A | * | 3/1939 | Roehm | 206/565 |
| 2,278,650 | A | * | 4/1942 | Drinkwater | 211/65 |
| D162,583 | S | | 3/1951 | Schmitman et al. | |
| 2,594,955 | A | | 4/1952 | Markowitz | 248/683 |
| 2,697,642 | A | | 12/1954 | Rudy | |
| 2,964,201 | A | * | 12/1960 | Huffman | 211/115 |
| 3,363,775 | A | | 1/1968 | Shaw | |
| 3,776,387 | A | * | 12/1973 | Brent | 211/70.6 |
| 4,105,239 | A | | 8/1978 | Akczinski, Sr. | 294/65.5 |
| 4,339,104 | A | | 7/1982 | Weidman | 248/407 |
| 4,573,569 | A | * | 3/1986 | Parker | 206/1.7 |
| 4,615,461 | A | * | 10/1986 | Liu | 220/815 |
| 4,826,059 | A | | 5/1989 | Bosch et al. | |
| 6,926,151 | B1 | * | 8/2005 | Perry et al. | 206/750 |
| 7,918,620 | B2 | | 4/2011 | Del Ponte | |
| 7,971,736 | B1 | | 7/2011 | Stewart | |
| 8,060,971 | B1 | | 11/2011 | Castelluccio | |
| 8,074,666 | B2 | | 12/2011 | Piao | |
| 2003/0000900 | A1 | | 1/2003 | Yu | |
| 2005/0156085 | A1 | * | 7/2005 | Radovan | 248/110 |
| 2006/0180559 | A1 | * | 8/2006 | Roberti | 211/65 |
| 2007/0056603 | A1 | | 3/2007 | Huh | |
| 2007/0119806 | A1 | * | 5/2007 | Le Sech | 211/133.1 |
| 2007/0199575 | A1 | * | 8/2007 | Del Ponte | 132/320 |
| 2009/0314788 | A1 | | 12/2009 | Douglas | |
| 2010/0043815 | A1 | | 2/2010 | Levy et al. | |

(Continued)

FOREIGN PATENT DOCUMENTS

| | | |
|---|---|---|
| WO | WO2010/027416 | 3/2010 |

*Primary Examiner* — Gary Hoge
(74) *Attorney, Agent, or Firm* — Livingston Loeffler, P.A.; Edward M. Livingston, Esq.; Bryan L. Loeffler, Esq.

(57) ABSTRACT

A cosmetic brush stand (1) having a horizontal base (3) and a vertical portion (4) extending upward therefrom. The vertical portion has a front surface (5) and a rear surface (6) with magnetic strips (9) located on either of both surfaces. Cosmetic brushes (2) are attracted to the magnetic strips via ferrules (8) made of a ferrous metal, a magnetized metal or an attachment sleeve (9) placed thereon. The magnetized sleeve may be used on conventional brushes having non-ferrous metal ferrules. A tray (16) having individual slots (17) or apertures may be located on the front surface and/or the rear surface to further secure the brushes to the brush stand. The brush stand may also be rotatable to provide easy access to the front surface and rear surface.

14 Claims, 3 Drawing Sheets

(56) References Cited

U.S. PATENT DOCUMENTS

2010/0236004 A1 9/2010 Xu
2012/0090117 A1* 4/2012 Akalin et al. ..... 15/167.1
2014/0325779 A1* 11/2014 Dansby ..... 15/168

* cited by examiner

MAGNETIC COSMETIC BRUSH STAND AND SLEEVE

CROSS-REFERENCE TO RELATED APPLICATIONS

This application is a continuation-in-part of application Ser. No. 13/482,608, filed on May 29, 2012. The patent application identified above is incorporated herein by reference in its entirety to provide continuity of disclosure.

FIELD OF THE INVENTION

This invention relates to cosmetic brushes and more particularly, a brush stand for cosmetic brushes and a sleeve that allows the brush stand to be used with conventional cosmetic brushes.

BACKGROUND OF THE INVENTION

Cosmetic brushes are available in a variety of sizes and shapes and are uses to apply makeup to different areas of the face. For example, various types of brushes are used to apply blush to the cheek area, eye shadow to the eye area and/or concealer to other areas of the face. Therefore, females commonly own several cosmetic brushes which are used for different applications of makeup.

Quality cosmetic brushes are an investment and in order for cosmetic brushes to have a long life and deliver consistent and accurate application, they need to be properly maintained and stored. Cosmetic brushes are commonly stored in cosmetic bags or pouches, which can be inconvenient because a female has to dig through the bag every time she wants to find a specific brush. Conventional cosmetic bags may also be detrimental to the brushes. Specifically, brushes should not be stored in an upright or sideways position after washing because water from the bristles can travel into the ferrule and damage the ferrule and the glue that holds the bristles, thereby shortening the useful life of the brushes.

Therefore, a need exists for a brush stand for cosmetic brushes that keeps the cosmetic brushes organized for easy use and provides for proper storage of the cosmetic brushes after being washed.

SUMMARY OF THE INVENTION

The primary object of the present invention is to provide a brush stand for cosmetic brushes that keeps the cosmetic brushes organized for easy use.

A further object of the present invention is to provide brush stand for cosmetic brushes that allows for proper storage of the cosmetic brushes for drying after being washed.

The present invention fulfills the above and other objects by providing a cosmetic brush stand having a horizontal base and a vertical portion extending upward having a front surface and a rear surface. Magnetic strips are located on the front surface and the rear surface. There are preferably at least two magnetic strips located on each surface to ensure that cosmetic brushes attached to each surface are held in a vertical position and do not move or rotate when the brush stand is moved. The cosmetic brushes are attracted to the magnetic strips via ferrules made of a ferrous metal, a magnetized metal or a magnetized sleeve placed thereon. The magnetized sleeve may be used on conventional brushes having non-ferrous metal ferrules and preferably has an inner layer of magnetized metal and an outer layer of rubber to provide a gripping surface while using the brush.

Alternatively or in addition to the magnetic strips, a tray having individual slots or apertures may be located on the front surface and/or the rear surface. The tray may be used to hold conventional brushes having non-ferrous metal ferrules in a vertical position. The tray also ensures spacing between brushes and prevents brushes held on the brush stand by the magnetic strips from being knocked off the brush stand.

An advantage of the brush stand is that a user may have a first set of brushes stored on the front surface and a second set of brushes stored on the rear surface. This allows the user to alternate use between sets of brushes to allow for washing and drying of each set while the other set is being used. The vertical portion may be rotatably attached to the horizontal base to allow a user to easily rotate the stand to access the front or rear surfaces. Alternatively, an upper portion of the base may be rotatably attached to a lower portion of the base to create a "lazy Susan" that allows the entire brush stand to be rotated.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
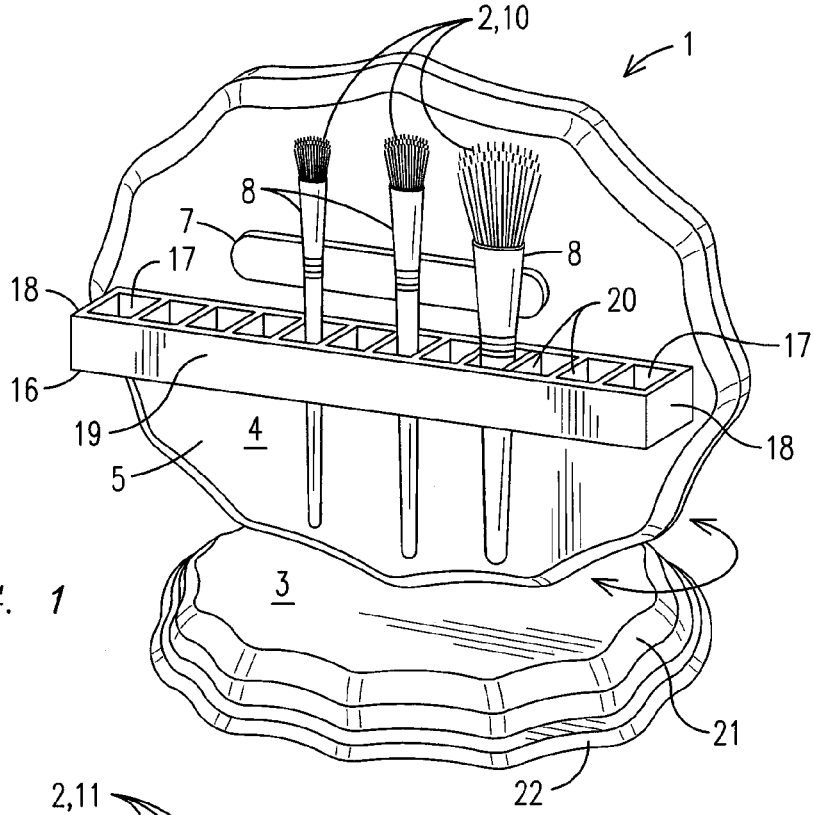
FIG. 1 is a perspective front view of a brush stand for cosmetic brushes of the present invention.

For purposes of describing the preferred embodiment, the terminology used in reference to the numbered components in the drawings is as follows:

1. brush stand, generally
2. cosmetic brush
3. horizontal base
4. vertical portion
5. front surface of vertical portion
6. rear surface of vertical portion
7. magnetic strip
8. ferrule
9. attachment sleeve
10. dry brush
11. wet brush
12. ferromagnetic material

Figure 2:
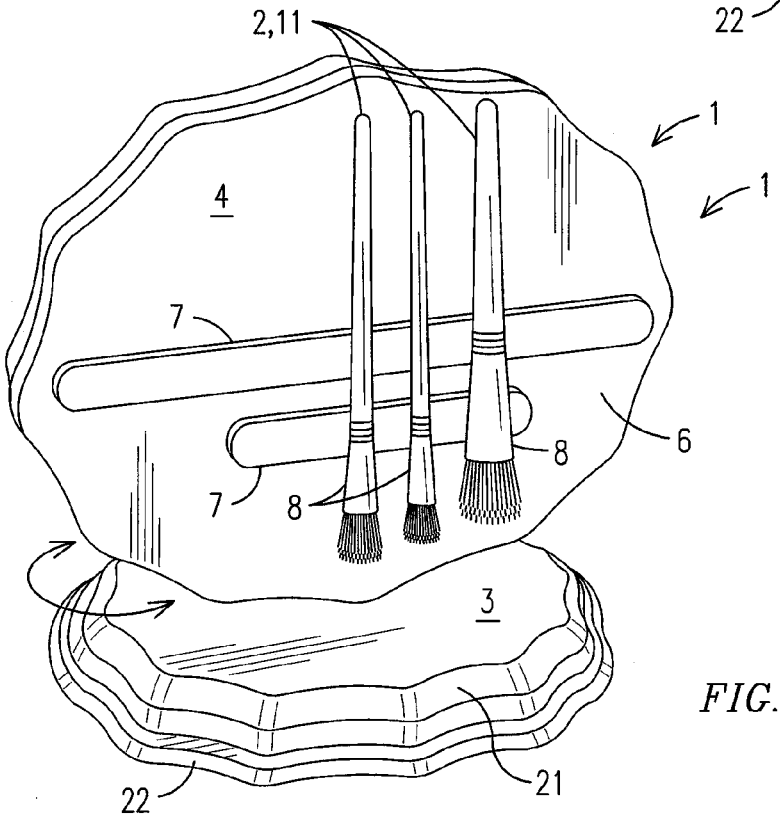
FIG. 2 is a perspective rear view of a brush stand for cosmetic brushes of the present invention.
Figure 3:
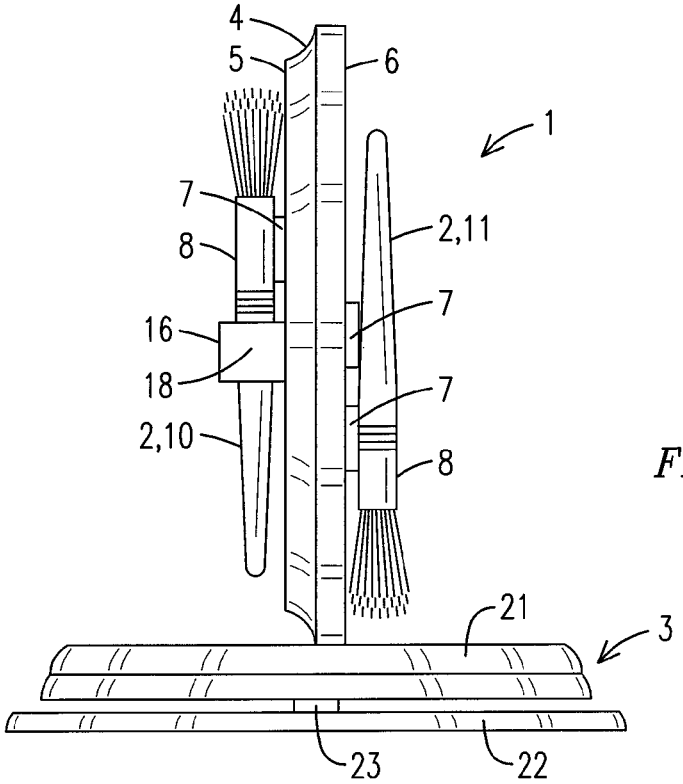
FIG. 3 is a side view of a brush stand for cosmetic brushes of the present invention.
Figure 4:
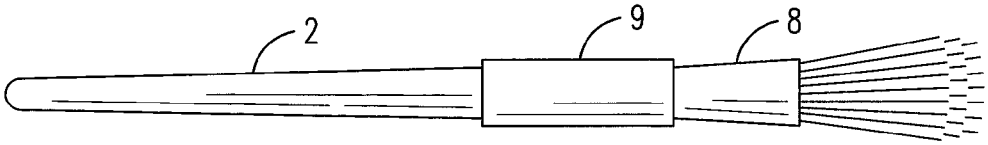
FIG. 4 is a side view of a cosmetic brush having an attachment sleeve of the present invention located thereon.

13. rubber
14. inner surface of attachment sleeve
15. outer surface of attachment sleeve
16. tray
17. slot
18. side panel
19. front panel
20. partition
21. upper portion of base
22. lower portion of base
23. rotation means With reference to FIGS. 1, 2 and 3, a perspective front view, a perspective rear view and a perspective side view, respectively, of a brush stand 1 for cosmetic brushes 2 of the present invention are illustrated. The brush stand 1 comprises a horizontal base 3 having a vertical portion 4 extending upward therefrom. The vertical portion 4 comprises a front surface 5 and a rear surface 6. One or more magnetic strips 7 may be located on the front surface 5 and/or the rear surface 6. There are preferably at least two magnetic strips 7 located on the front surface 5 and the rear surface 6 to ensure that cosmetic brushes 2 attached to the front surface 5 and the rear surface 6 are held in vertical positions and do not move or rotate when the brush stand is moved. The cosmetic brushes 2 are attracted to the magnetic 7 strips via ferrules 8 made of a ferrous metal, a magnetized metal or an attachment sleeve 9 (as illustrated in FIG. 4) placed thereon. The brush stand 1 allows the user to alternate use between sets of brushes 7 to allow for washing and drying of one set while the other set is being used. As illustrated here, a first set of dry brushes 10 is stored on the front surface 5 in an upright position while a second set of wet brushes 11 is stored on the rear surface in a downward position to prevent water from collecting in the ferrules 8 while the second set of brushes 11 are drying.

Figure 7:
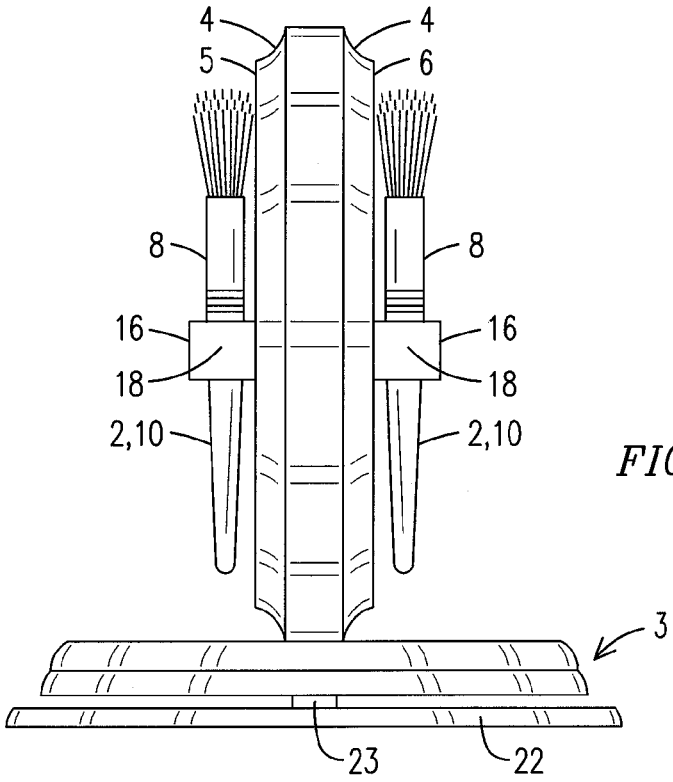
FIG. 7 is a side view of a brush stand for cosmetic brushes of the present invention having a tray located on the front surface and a tray located on the rear surface.
Figure 8:
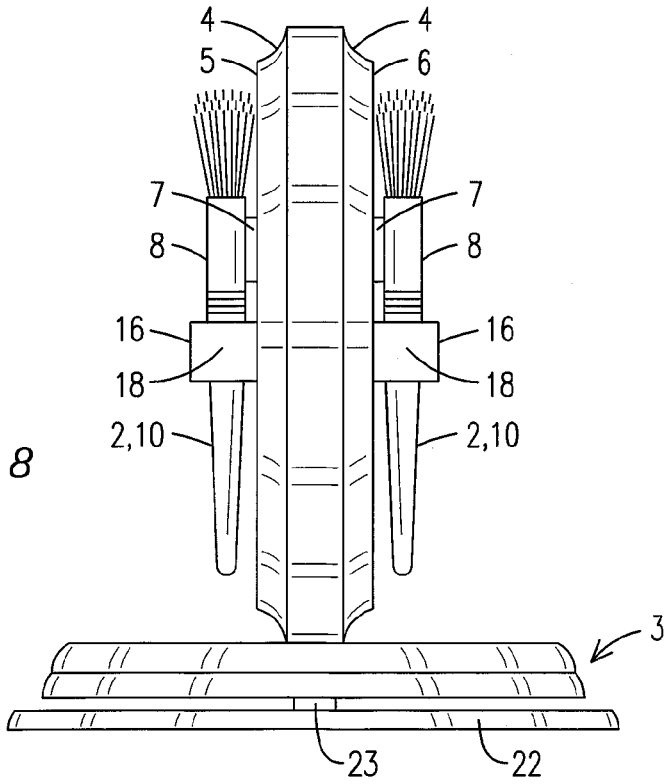
FIG. 8 is a side view of a brush stand for cosmetic brushes of the present invention having a tray and a magnetic strip located on the front surface and a tray and a magnetic strip located on the rear surface.

Alternatively or in addition to the magnetic strips 7, a tray 16 having individual slots 17 or apertures may be located on the front surface 5 and/or the rear surface 6, as illustrated in FIGS. 7 and 8. The tray 16 may be used to hold conventional brushes 2 having non-ferrous metal ferrules in a vertical position. The tray 16 also ensures spacing between brushes 2 and prevents brushes 2 held on the brush stand by the magnetic strips from being knocked off the brush stand. The tray 16 comprises two side panels 18 extending from the front surface 5 or the rear surface 6 and a front panel 19 separated from the front surface 5 or the rear surface 6. Partitions 20 create slots 17 or apertures for holding the brushes 2. One or more trays 16 may be on the front surface 5 and/or rear surface 6 in addition to or in lieu of magnetic strips 7 as illustrated in FIGS. 7 and 8.

The vertical portion 4 may also be rotatably attached to the horizontal base 3, thereby allowing a user to spin the vertical portion 4 to access the front surface 5 or the rear surface 6. Alternatively, an upper portion 21 of the base 3 may be rotatably attached to a lower portion 22 of the base via a rotation means 23 to create a "lazy Susan" that allows the entire upper portion 21 of the base 3 and brush stand 1 to be rotated. The upper portion 21 of the base 3 may be rotated without affecting handles of cosmetic brushes 2 that are resting on the upper portion 21 of the base 3, as illustrated in FIG. 1.

With reference to FIG. 4, a side view of a cosmetic brush 2 having an attachment sleeve 9 of the present invention located thereon is illustrated. The magnetized sleeve is preferably made of a stretchable material and is tubular so that it may be used on conventional cosmetic brushes 2 having non-ferrous metal ferrules 8 so the cosmetic brushes 2 may be stored on the brush stand 1 of the present invention.

Figure 5:
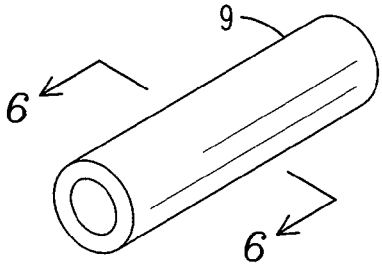
FIG. 5 is a perspective side view of an attachment sleeve of the present invention.
Figure 6:
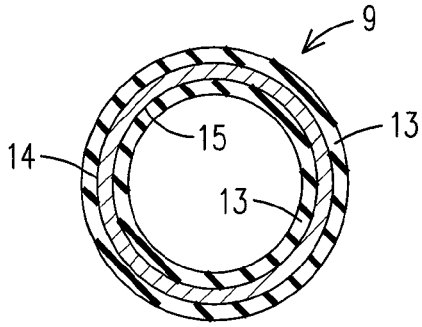
FIG. 6 is a cross section along lines 6-6 of FIG. 5 of an attachment sleeve of the present invention.

With reference to FIGS. 5 and 6, a perspective side view, and a cross section along lines 6-6 of FIG. 5, respectively, of an attachment sleeve 9 of the present invention are illustrated. The attachment sleeve 9 comprises an inner layer of ferromagnetic material 12 encased in a layer of rubber 13 to provide a gripping surface on the outer surface 14 of the attachment sleeve 9 for holding the brush in a user's fingers and a gripping surface on the inner surface 15 of the attachment sleeve 9 to hold the attachment sleeve 9 in place on a cosmetic brush 2.

The attachment sleeve 9, may also be made of a magnetic rubber, or rubber having a ferromagnetic material embedded in the rubber. The magnetic sleeve 9 may also be made of a cloth, woven or net material having elastomeric properties. Said cloth, woven or net material may encase one or more magnets, have one or magnets attaches to an inner or outer surface, have magnetic properties or be embedded with magnetic material.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A brush stand comprising:
a horizontal base having a flat lower surface for resting the base on a surface;
a vertical portion extending upward from a central portion of said horizontal base;
said vertical portion is perpendicular to said horizontal base;
said vertical portion is located directly above said horizontal base;
said vertical portion having a front planar surface and a rear planar surface;
at least one magnetic strip located on the front surface of the vertical portion for attaching cosmetic brushes thereto;
said at least one magnetic strip being parallel with the horizontal base;
at least one tray located on the rear surface of the vertical portion;
said at least one tray each having two side panels extending from the rear surface;
said two side panels being connected by a front panel;
said front panel being separated from the rear surface by the two side panels to create a slot for holding at least one cosmetic brush within the tray.

2. The brush stand of claim 1 wherein:
said at least one tray further comprises at least one partition located between the at least two side panels; and
said at least one partition extending from the rear surface to the front panel to create a plurality of slots within the at least one tray.

3. The brush stand of claim 1 further comprising:
a magnetic strip located on the rear surface of the vertical portion proximate to the at least one tray to further secure the brushes on the brush stand within the at least one tray.

4. The brush stand of claim 1 wherein:
said vertical portion being rotatable about a vertical axis so that the vertical portion can be turned around without changing the orientation of any cosmetic brushes attached thereto.

5. The brush stand of claim 1 wherein:

said base having an upper portion and a lower portion; and said upper portion of the base being rotatably attached to the lower portion of the base to allow the upper portion of the base and the vertical portion to be rotated.

6. A brush stand comprising:

a horizontal base having a flat lower surface for resting the base on a surface;

a vertical portion extending upward from a central portion of said horizontal base;

said vertical portion is perpendicular to said horizontal base;

said vertical portion is located directly above said horizontal base;

said vertical portion having a front planar surface and a rear planar surface;

at least one tray located on the rear surface of the vertical portion;

said at least one tray located on the rear surface of the vertical portion each having two side panels extending from the rear surface being connected by a front panel that is separated from the rear surface by the two side panels to create a slot for holding one or cosmetic brushes within the tray;

at least one tray located on the front surface of the vertical portion; and said at least one tray located on the front surface of the vertical portion each having two side panels extending from the front surface being connected by a front panel that is separated from the front surface by the two side panels to create a slot for holding at least one cosmetic brush within the tray.

7. The brush stand of claim 6 wherein:

a magnetic strip located on the rear surface of the vertical portion proximate to the at least one tray located on the rear surface; and a magnetic strip located on the front surface of the vertical portion proximate to the at least one tray located on the front surface.

8. The brush stand of claim 6 wherein:

said at least one tray located on the rear surface further comprises at least one partition located between the at least two side panels extending from the rear surface to the front panel to create a plurality of slots within the at least one tray located on the rear surface; and said at least one tray located on the front surface further comprises at least one partition located between the at least two side panels extending from the front surface to the front panel to create a plurality of slots within the at least one tray located on the front surface.

9. The brush stand of claim 6 wherein:

said vertical portion being rotatable about a vertical axis so that the vertical portion can be turned around without changing the orientation of any cosmetic brushes attached thereto.

10. The brush stand of claim 6 wherein:

said base having an upper portion and a lower portion; and said upper portion of the base being rotatably attached to the lower portion of the base to allow the upper portion of the base and the vertical portion to be rotated.

11. A brush stand comprising:

a horizontal base having a flat lower surface for resting the base on a surface;

a vertical portion extending upward from a central portion of said horizontal base;

said vertical portion is perpendicular to said horizontal base;

said vertical portion is located directly above said horizontal base;

said vertical portion having a front planar surface and a rear planar surface;

at least one tray located on the front surface of the vertical portion;

said at least one tray located on the front surface of the vertical portion each having two side panels extending from the front surface being connected by a front panel that is separated from the front surface by the two side panels to create a slot for holding at least one cosmetic brush within the tray;

a magnetic strip located on the front surface of the vertical portion proximate to the at least one tray to further secure the brushes on the brush stand within the at least one tray located on the front surface of the vertical portion;

at least one tray located on the rear surface of the vertical portion;

said at least one tray located on the rear surface of the vertical portion each having two side panels extending from the rear surface being connected by a front panel that is separated from the rear surface by the two side panels to create a slot for holding at least one cosmetic brush within the tray; and a magnetic strip located on the rear surface of the vertical portion proximate to the at least one tray to further secure the brushes on the brush stand within the at least one tray located on the rear surface of the vertical portion.

12. The brush stand of claim 11 wherein:

said at least one tray located on the front surface further comprises at least one partition located between the at least two side panels; and said at least one tray located on the rear surface further comprises at least one partition located between the at least two side panels.

13. The brush stand of claim 11 wherein:

said vertical portion being rotatable about a vertical axis so that the vertical portion can be turned around without changing the orientation of any cosmetic brushes attached thereto.

14. The brush stand of claim 11 wherein:

said base having an upper portion and a lower portion; and said upper portion of the base being rotatably attached to the lower portion of the base to allow the upper portion of the base and the vertical portion to be rotated.

* * * * *